United States Patent [19]

Hahlbrock et al.

[11] 4,035,022

[45] July 12, 1977

[54] SELF-PROPELLED PICKUP DEVICE FOR PICKING UP MATERIALS LYING ON THE BOTTOM OF THE SEA

[75] Inventors: Udo Hahlbrock, Lubeck; Siegfried Steinkühler, Bad Schwartau; Heinz-Werner Vagt, Bad Schwartau; Johann-Gustav Voss, Bad Schwartau; Ulrich Wäntig, Lubeck, all of Germany

[73] Assignee: O & K Orenstein & Koppel Aktiengesellschaft, Germany

[21] Appl. No.: 653,729

[22] Filed: Jan. 30, 1976

[30] Foreign Application Priority Data

Feb. 5, 1975 Germany ..... 2504694

[51] Int. Cl.[2] ..... E02F 7/00

[52] U.S. Cl. ..... 299/8; 37/57; 37/71; 37/DIG. 8

[58] Field of Search ..... 299/8, 9, 1; 37/57, 37/DIG. 8, 54, 71; 180/1 H, 7 A

[56] References Cited

U.S. PATENT DOCUMENTS

| | | | |
|---|---|---|---|
| 2,288,701 | 7/1942 | Heden | 37/71 X |
| 3,224,407 | 12/1965 | Bertrand | 180/7 A X |
| 3,440,742 | 4/1969 | Goldstein | 37/71 X |
| 3,731,975 | 5/1973 | Lindelof | 299/8 |
| 3,740,098 | 6/1973 | Lachnit | 299/8 |

*Primary Examiner*—Ernest R. Purser
*Attorney, Agent, or Firm*—McGlew and Tuttle

[57] ABSTRACT

The device comprises an undercarriage extending transversely of the working direction of the device, and supported, at its opposite ends, by respective pairs of worms with the worms of each pair rotating in respective opposite directions. A cantilever bracket is mounted on the forward side of the undercarriage, considered in the working direction. A plurality of conveyor troughs are mounted, for pivoting about a horizontal axis, on the forward edge of the undercarriage, and respective hydraulic actuators are connected between each trough and the cantilever bracket, so that the troughs, which are inclined rearwardly and upwardly, may be adjusted with respect to their angular orientation. Struts extending rearwardly from the undercarriage connect the undercarriage to a third driving unit which may comprise either a pair of oppositely rotating worms having their axes extending in the working direction or two laterally spaced pairs of worms. A respective endless scraper chain extends along each trough, and each trough has a cutting tool at its lower forward end. At the upper rearward end of the conveyor trough the cut material is discharged into transversely extending endless conveyors which convey the material to an upwardly and rearwardly extending inclined endless belt covered by an endless cover belt. The endless conveyor belt delivers the material to an inclined classifying screen above which there is arranged a pressure water supply. The undesired material drops through the screen while the desired material slides over the screen into a hopper leading to an elevator. The several pairs of worms provide essentially a three-point support for the device.

22 Claims, 5 Drawing Figures

SELF-PROPELLED PICKUP DEVICE FOR PICKING UP MATERIALS LYING ON THE BOTTOM OF THE SEA

FIELD AND BACKGROUND OF THE INVENTION

This invention is directed to a self-propelled pickup device for picking up materials, such as manganese lumps, lying on the bottom of the sea, including horizontal cutting tools cutting into the sea bottom and a cooperating conveyor. More particularly, the present invention is directed to a substantially improved pickup device of this type.

A known device of this type travels on the bottom of the sea by means of a caterpillar drive. This known device is provided with two coaxially arranged and oppositely rotating worms at its front end, considered in the driving direction. The receiving part of a bucket conveyor terminates between these worms, and the bucket conveyor feeds the material to an elevator or an elevating conveyor. Baffle plates are arranged behind the worms, and are adapted to the form of the worms, and these baffle plates enhance the transportation of the material by the worms to the bucket conveyor.

In this known device, there is the risk that the materials engaged by the worms, or the materials lying in the proximity of the rotating worms and beginning to move, will penetrate into the solid ground or move out of the conveying range of the worms, so that these materials are not gripped and thus are lost. Another disadvantage of the known device is that the caterpillar drive is not effective, due to the insufficiently solid surface of the ground. Such an arrangement is shown, for example, in U.S. Pat. No. 3,314,174.

There is also known as underwater scraper with a cutting asssembly scraping the bottom of the sea, and with the cutting assembly consisting of a cutter, carried by a linkage, with the linkage being secured on the traveling gear for pivoting about a horizontal axis. The conveyor consists of a conveyor wheel with edges extending upwardly and outwardly, and a conveyor belt which is guided, in the range of the material to be conveyed, between the edges of the conveyor wheel. The conveyor wheel is provided with movably mounted spades which are controlled by a cam disc guide arranged inside the wheel in such a manner that the spades can extend substantially in the radial direction through the space formed by the conveyor belt. In this arrangement, the spades penetrate into the space in front of the cutters, so that there is also a risk that the materials to be conveyed will begin to move before they are engaged by the pickup device and thus are lost. This arrangement is shown in German DOS 2,055,410.

A further known self-propelled pickup device is provided with three traveling rollers, and consists of suction heads with suction channels provided in the forward part in the direction of motion, these suction channels leading to a suction device. Flexible extensions, spaced from each other in order to facilitate the loosening and pickup of the material lying on the bottom of the sea, are arranged at the front edge of the suction heads. This arrangement, which is disclosed in U.S. Pat. No. 3,504,943, also has the disadvantages of the already-mentioned known pickup devices.

SUMMARY OF THE INVENTION

The present invention is directed to the problem of designing a traveling pickup device, of the above-mentioned type, in such a manner that losses, in picking up the material lying on the bottom of the sea, are avoided as far as possible, while the device is simple in design, safe, and capable of working trouble-free at the great depths in question, so it can be operated over a long period of time without requiring attendance. Furthermore, the drive of such a device should be so designed that the traveling gears cannot become stuck during their movement or dig in to the bottom of the sea.

In accordance with the invention, a pickup device of the mentioned type has a cutting tool connected to an upwardly inclined conveyor trough which feeds the material to an elevator, and an endless scraper chain is arranged to extend along the upper surface of the conveyor trough. The invention device thus has the advantage that there are no mechanisms in the front range of the cutting tools and which could set the materials, lying on the ground, in motion. The materials cannot yield downwardly, so that the materials lying on the cutting tools are fed by the scraper chain along the conveyor trough and thus transported to the elevator. Due to the arrangement of the cutting tools in accordance with the invention, accumulation of the material, during the pickup, is prevented.

In order to make certain that the undercut material does not yield or become lost, the scraper chain can extend up to the front region of the cutting tools. Furthermore, in order to adjust the cutting depth, or to adapt the position of the cutter to the form of the ground, the conveyor trough can be pivotally mounted, at its discharge end, about a horizontal transverse axis in an undercarriage and can be adjustable in height.

In another embodiment of the invention, the conveyor trough and the scraper chain are suspended by a linkage on a horizontal axle arranged above the receiving range of the cutting tool, for pivoting relative to an undercarriage or a cantilever bracket on the undercarriage. This suspension has the advantage that the conveyor rough segment thus formed can yield, in a direction opposite to the traveling direction, in the presence of obstacles. On the other hand, however, the drop point at the upper end of the conveyor trough remains substantially in the same range. With small obstacles, the conveyor trough segment can yield and thus overcome the obstacle. An advantage is that the cutting depth adjusts itself practically solely by its own weight and in response to the resistance of the sea bottom during the cutting.

In accordance with another feature of the invention, the conveyor trough, or the conveyor trough segment, can be designed so that an indicating device or a control device can be started when the conveyor swings through a preselected adjustable angle. The control device can slow the drive, for example, or initiate any other control action.

Particularly in the case of pickup devices with a long cutting front, it is preferable to arrange several conveyor troughs side by side so that they can be pivoted on the undercarriage, and adjusted in height, independently of each other. Respective vertical adjustment means can be connected between the conveyor troughs and the undercarriage, or a cantilever on the undercarriage, for the purpose of angularly adjusting the conveyor troughs.

In accordance with another feature of the invention, the vertical adjustment of the conveyor trough, or of any of several conveyor troughs, can be effected automatically, by measuring instruments, in dependence on the selected depth of the cutting tool. Such a pickup device can move along an uneven sea bottom with each cutting tool adjusting itself automatically to a selected depth.

In a simple embodiment of the invention, several juxtaposed conveyor troughs are arranged on the undercarriage, and a cross-conveyor, extending transversely of the troughs, is arranged adjacent the upper ends or drop points of the troughs, this cross-conveyor being supported in the undercarriage and transporting the material to an elevator.

Preferably, a classifier is arranged in the transportation path between the conveyor troughs and the elevator or elevating conveyor. The classifier can comprise an inclined classifying screen, having water under pressure directed to its front side.

In order to avoid loss of material inside the pickup device, the inclined elevator conveyor or conveyors can be covered, to the fullest extent possible, by endless covering belts. For a satisfactory drive of the pickup device, the drive can consist of several pairs of worms extending in the traveling direction, each pair including two oppositely rotating worms. The worms ccan be multiple worms, particularly quadruple worms. For the purpose of a simple adjustment of the vertical position of the pickup device, the pairs of worms can be vertically adjustable. A simple embodiment comprises two pairs of worms, with each pair at a respective opposite end of the undercarriage and associated with hydraulic adjusting means. The worm drive avoids unnecessary digging of the sea bottom. Furthermore, it is advantageous to fill the worms with a pressure absorbing lifting material, such as a synthetic foam material, in order to increase the mechanical resistance.

An object of the invention is to provide an improved traveling pickup device for picking up material lying on the sea bottom.

Another object of the invention is to provide such a device which is simple in design, safe, and capable of working trouble-free at great depths so that it can be operated over a long period of time without requiring attendance.

A further object of the invention is to provide such a device having driving means which cannot become stuck during their movement or dig into the sea bottom.

For an understanding of the principles of the invention, reference is made to the following description of typical embodiments thereof as illustrated in the accompanying drawings.

DESCRIPTION OF THE PREFERRED EMBODIMENTS

Figure 1:
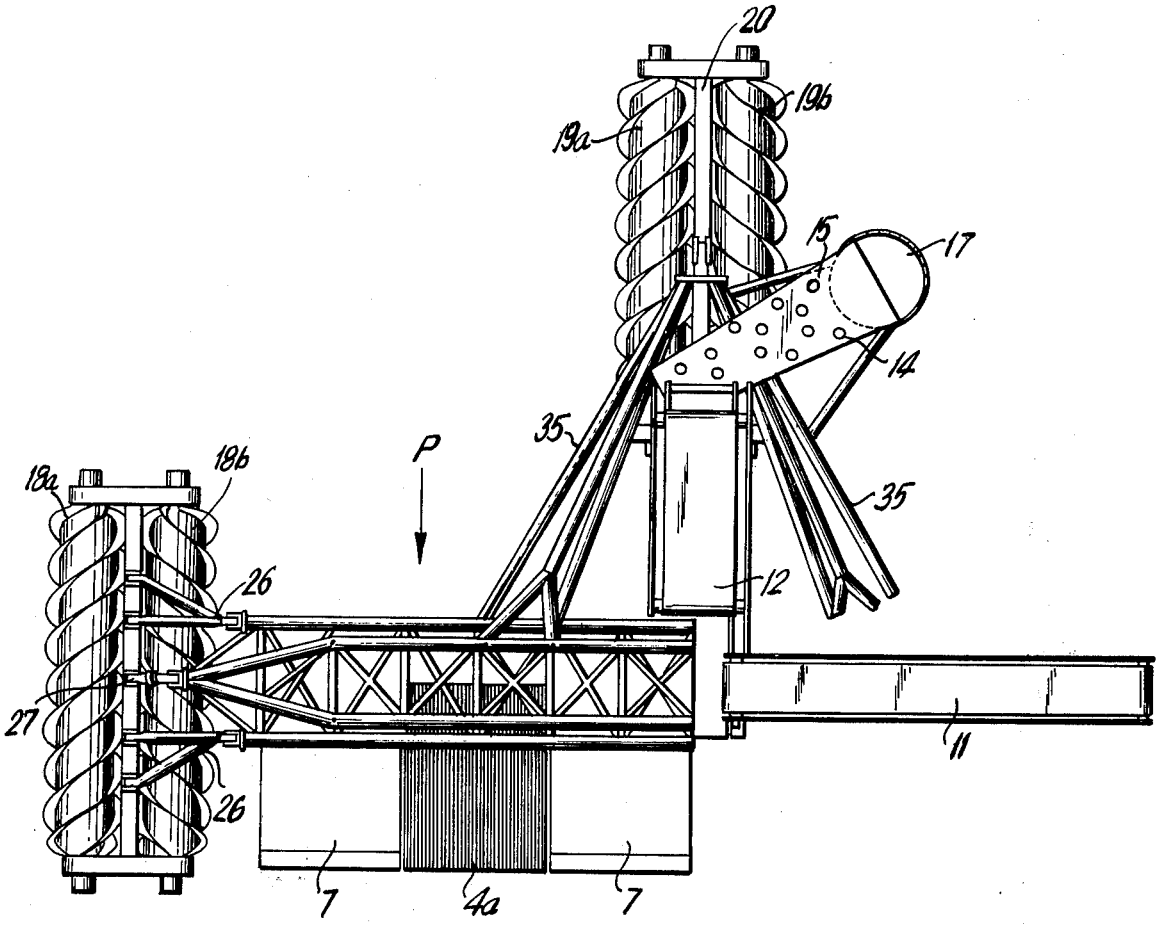
FIG. 1 is a top plan view of the device, with the right-hand portion being shown as a partial section.
Figure 2:
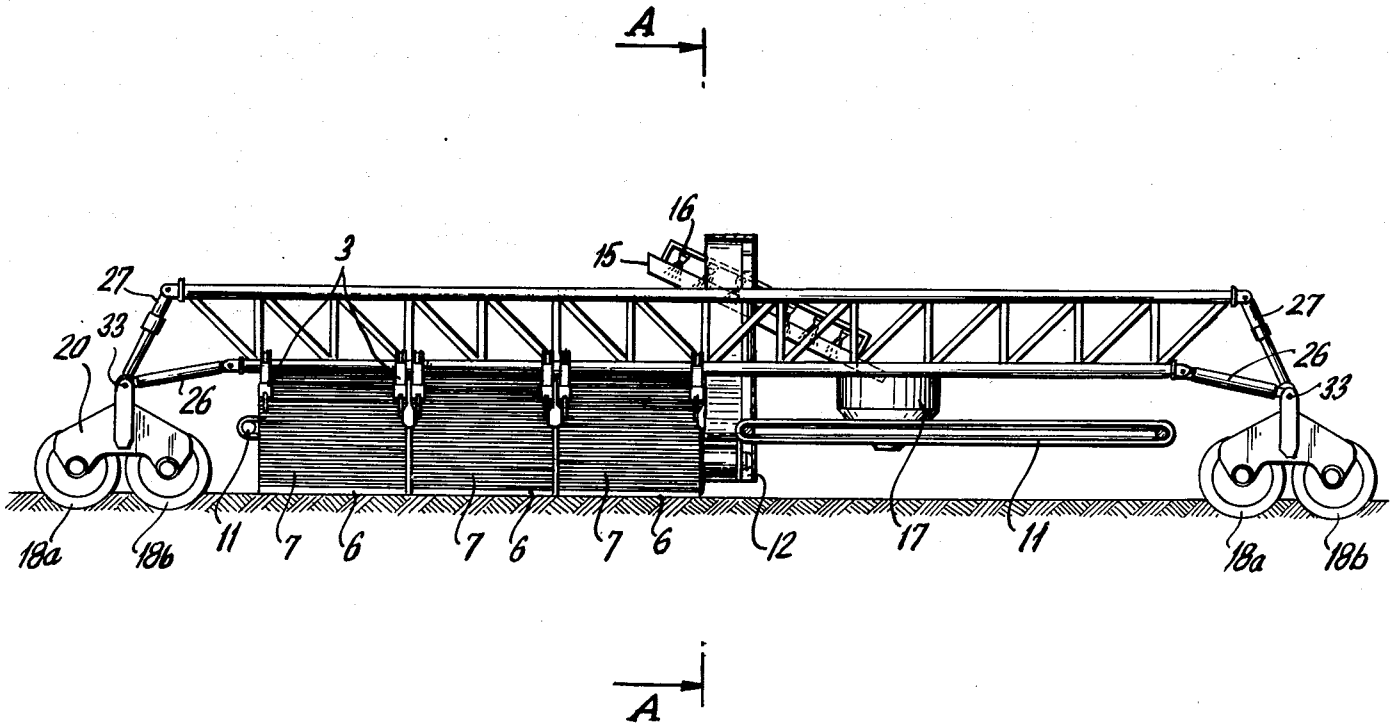
FIG. 2 is a front elevation view of the device, with the righthand portion being shown as a section.
Figure 3:
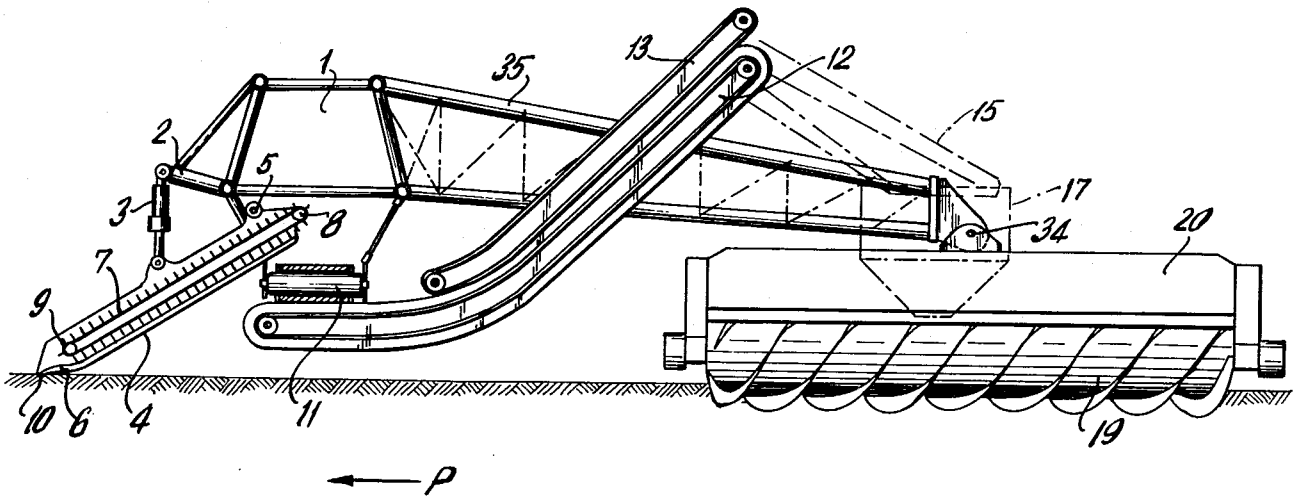
FIG. 3 is a longitudinal vertical sectional view of the device taken on the line A—A of FIG. 2.

Referring first to FIGS. 1, 2 and 3, the illustrated pickup device comprises an undercarriage 1, having a trapezoidal cross-section, extending transversely of the working direction P of the device. A cantilever bracket 2 is mounted on the front side, considered in the traveling direction, of undercarriage 1, and has several hydraulic actuators 3, constituting vertical adjustment means, articulated thereon. Six conveyor troughs 4 are supported, in juxtaposed relation to each other, on undercarriage 1 for swinging movement about a horizontal axis 5 extending longitudinally of the undercarriage. Two vertical adjusting means 3 are associated with each conveyor trough, one acting on each side of the respective conveyor trough. It will be noted that troughs 4 extend upwardly and rearwardly.

The lower forward end of each conveyor trough 4 carries a respective cutting tool 6, and a respective endless scraper chain 7 extends longitudinally of the upper surface of each conveyor trough 4 to grip and transport the material undercut by the associated cutting tool 6. The material is thus moved upwardly and rearwardly along each conveyor trough 4 and discharged at the upper end thereof at a drop point 8. Each scraper chain 7 is so located that its front end is advanced sufficiently far that the cut material is gripped by the scraper chain as soon as it is undercut by the cutting tools 6.

The front end 10 of each cutting tool 6 is adjusted, by means of the associated vertical adjusting means 3, to a cutting depth in dependence upon the existing conditions relative to the surface of the ground or the sea bottom. This cutting depth can vary, in dependence on the material of the sea bottom, on the depth to which the material to be gripped is deposited, etc. The adjustment of the cutting depth can be effected by means of measuring instruments, which have not been shown. The adjustment of the cutting depth depends, on the one hand, on the sinking depth of the undercarriage in the sea bottom, that is, the vertical position of the pickup device relative to the ground and, on the other hand, the adjustment of the cutting tools is effected in dependence on the desired cutting depth, that is, the distance between the cutting edge of the cutting tools and the surface of the ground. These adjustments can be regulated automatically with known measuring instruments.

Beneath the drop points 8 of the several juxtaposed conveyor troughs 4 there are arranged two cross-conveyors 11, in the undercarriage 1, one extending to each side of the center of undercarriage 1. These cross-conveyors 11 conduct the material, moved upwardly by the scraper chain 7 to the drop points 8, to an inclined elevating conveyor 12 arranged at the center of undercarriage 1. Elevating conveyor 12 may comprise an endless conveyor belt of a selected design. In order to avoid material losses, belt 12 is covered by an endless covering belt 13.

Inclined elevating conveyor 12 delivers the material to a classifier 14 which, in the illustrated embodiment, includes an inclined classifying screen 15. Above screen 15, there is arranged a pressure water supply 16, for example, in the form of several juxtaposed nozzles, etc. The washed ground material drops through the apertures of classifying screen 15, while the desired material, such as manganese lumps, slides over screen 15 into a hopper 17 which, in turn, leads to an elevator or an elevating conveyor which has not been shown in order to simplify the drawings.

Undercarriage 1 has driving gears at each of its opposite ends, to drive the undercarriage in the direction P. Each driving gear, in the embodiment shown in FIG. 1, comprises a pair of worms 18*a* and 18*b*, with the worms of each pair being closely adjacent each other and rotating in respective opposite directions. The worms are quadruple worms. The two pairs of worms at the opposite ends of undercarriage 1 are articulated through a control handle or arm 26, and each pair is vertically adjustable by means of an associated hydraulic cylinder 27. The vertical position of the pickup device can thus be regulated. For complete adaptation to unevenesses of the sea bottom, the pairs of worms 18*a*, 18*b* can also be mounted for pivoting about respective horizontal axes 34.

By means of struts 35, converging rearwardly from undercarriage 1, the undercarriage is mounted on a third pair of worms 19*a*, 19*b* which are substantially of the same form and driving arrangement as the worms 18*a* and 18*b*, with the worms 19*a* and 19*b* being parallel and closely adjacent each other and rotating in respective opposite directions. Thus, there is formed a three-point support for the device. The frames 20 for each pair of worms are pivotal about horizontal axes, such as the axes 33 and 34, but alternatively, these frames can be secured immovably to undercarriage 1.

Figure 4:
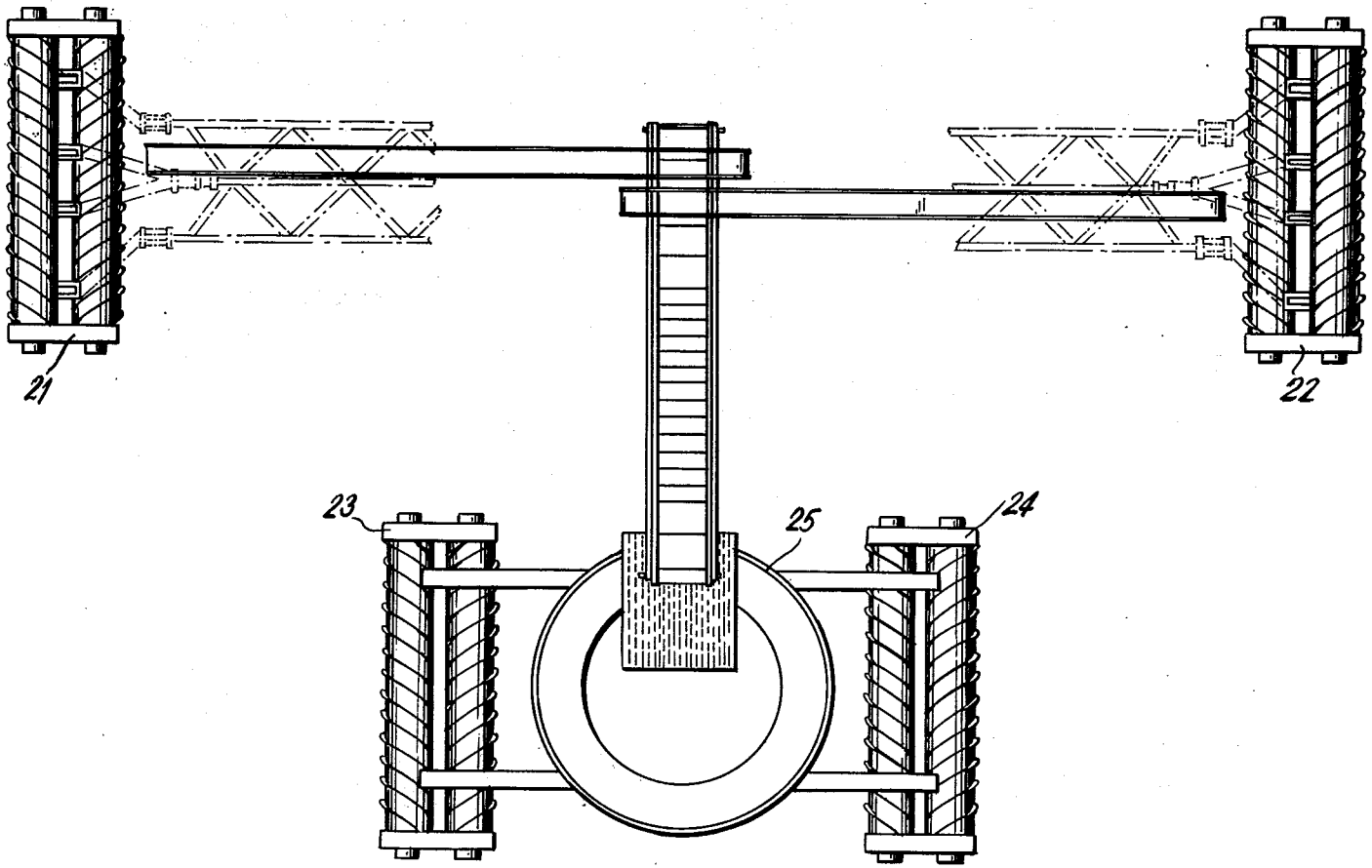
FIG. 4 is a partial top plan view of another embodiment of the device.

The embodiment of the invention shown in FIG. 4 differs from that shown in FIGS. 1, 2 and 3, in that four pairs of worms 21, 22, 23 and 24 are used as the driving gears, the pair of worms 19*a*, 19*b* of FIGS. 1, 2 and 3 being replaced, so to speak, by the pairs 23 and 24. The classifier 14 can be arranged between the pairs of worms 23 and 24, as can also be the lower end of the elevator 17 and other related parts. The pairs of worms 23 and 24 can be combined to form another undercarriage 25, which is connected with undercarriage 1 for pivoting about a vertical axis and also about horizontal axes, if necessary.

Figure 5:
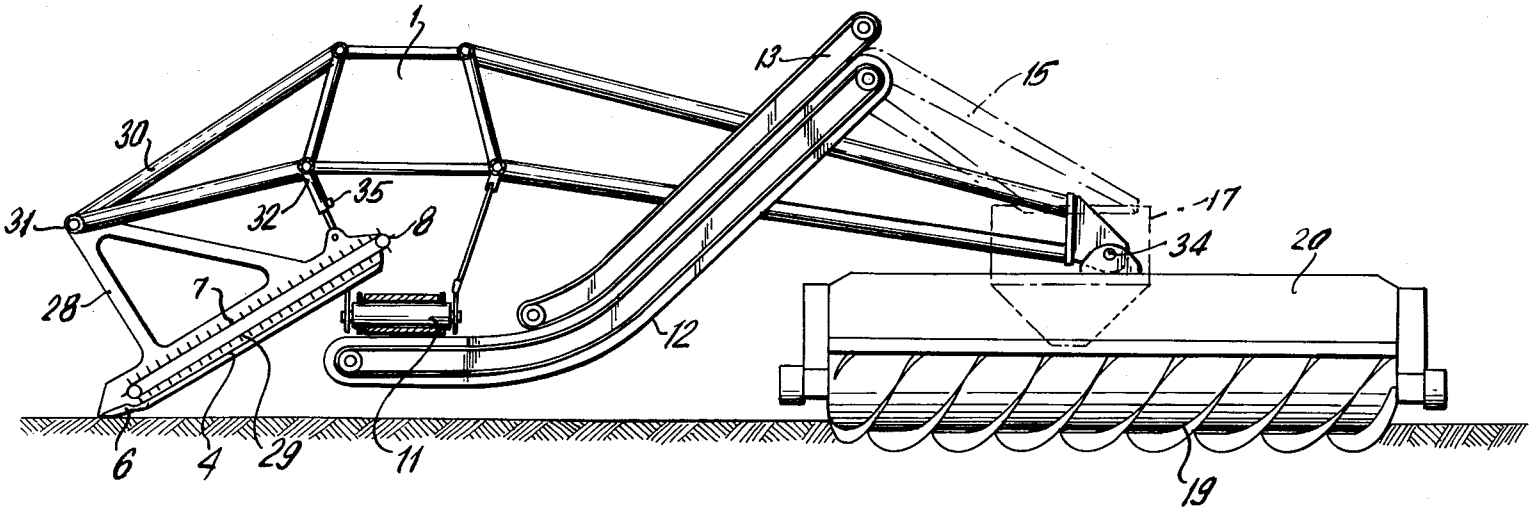
FIG. 5 is a view, similar to FIG. 3, but illustrating another modified embodiment of the invention.

The third embodiment of the invention, shown in FIG. 5, differs from that shown in FIGS. 1, 2 and 3 substantially in that each conveyor trough 4 is combined with the associated endless scraper chain 7 and a linkage 28 to form a conveyor trough segment 29. The conveyor trough segments 29 are mounted, for pivotal movement about a horizontal axis 3;, on a cantilever bracket 30 secured to undercarriage 1. Axis 31 extends transversely substantially above the range of the cutting tools 6. Vertical adjustment can be effected by means of a hydraulic cylinder 32 articulated between undercarriage 1 and conveyor trough segment 29.

The embodiment of FIG. 5 has the advantage that the vertical-position of the cutting tools adjusts automatically in dependence on the firmness of the ground, such as the sea bottom. Another advantage is that conveyor trough segment 29 swings upward to the rear in the presence of an obstacle, and can then run over the obstacle in this position. Conveyor trough segment 29 furthermore can be provided with a measuring device 35 which records and indicates the deflection angle of the conveyor trough segment. Measuring device 35 can be articulated, for example, between linkage 28 and cantilever bracket 30, and can be used not only for indicating purposes but also for regulating the drive, for shutting off the drive, etc.

For separating undesirable sediments, conveyor trough 4 may be provided with a screen or grating through which undesirable sediment can pass downwardly. This screen or grating is shown, in the embodiment of FIG. 1, as a bar grate bottom 4*a* for the central conveyor trough, with the scraper chain 7 of the central conveyor trough being omitted. This design has the advantage that the pickup device is not burdened with undesirable sediments, so that following conveying elements may be designed with smaller dimensions.

A further advantage of the present invention is that the drop points 8 of conveyor troughs 4 always remain in the range of cross-conveyors 11, so that there are no interruptions in the transfer of the material.

While specific embodiments of the invention have been shown and described in detail to illustrate the application of the principles of the invention, it will be understood that the invention may be embodied otherwise without departing from such principles.

What is claimed is:

1. In a self-propelled pickup device, for picking up material, such as manganese lumps, lying on the bottom of the sea, of the type having at least one cutting tool cutting into the ground and a cooperating conveying device, the improvement comprising, in combination, an undercarriage; means mounting said undercarriage for movement over the sea bottom; at least one upwardly and rearwardly inclined and forwardly projecting conveyor trough mounted on said undercarriage; a respective non-rotatable cutting tool mounted on and projecting from the leading lower end of each conveyor trough to dig into the ground, to a selected depth, responsive to forward movement of said undercarriage, for movement of the cut material over the upper surface of the cutting tool and onto the associated trough; elevating means; each conveyor trough feeding material to said elevating means; and a respective scraper chain extending along each conveyor trough to move material upwardly therealong.

2. In a self-propelled pickup device, the improvement claimed in claim 1, including a respective linkage supporting each conveyor trough and its associated scraper chain on said undercarriage for pivoting about a horizontal axis extending above the receiving range of said cutting tools.

3. In a self-propelled pickup device, the improvement claimed in claim 1, including a respective linkage supporting each conveyor trough and its associated scraper chain on a cantilever bracket secured to said undercarriage, for pivoting about a horizontal axis extending about the receiving ange of said cutting tools.

4. In a self-propelled pickup device, the improvement claimed in claim 3, including a conveyor trough movement detecting device operable responsive to swinging of a conveyor trough through a certain preselected angle to provide output signals.

5. In a self-propelled pickup device, the improvement claimed in claim 1, in which each conveyor trough is mounted, for pivoting about a horizontal axis, on said undercarriage adjacent the respective drop point for material at the upper end of the conveyor trough; each conveyor trough being adjustable in height.

6. In a self-propelled pickup device, the improvement claimed in claim 5, including a plurality of conveyor troughs arranged in juxtaposed relation on said undercarriage and being pivotal and adjustable in height independently of each other.

7. In a self-propelled pickup device, the improvement claimed in claim 6, including adjusting means acting between each conveyor trough and a point fixed with respect to said undercarriage, and operable to adjust the height of the associated conveyor trough.

8. In a self-propelled pickup device, the improvement claimed in claim 7, including respective means automatically effecting adjustment of each conveyor trough in dependence on the preselected cutting depth of the associated cutting tool.

9. In a self-propelled pickup device, the improvement claimed in claim 7, including cross-conveyors mounted on said undercarriage and extending beneath the drop points of said conveyor troughs to receive the material moved upwardly along said conveyor troughs; and elevating means receiving material from said cross-conveyors.

10. In a self-propelled pickup device, the improvement claimed in claim 9, including a material classifier positioned along the path of transportation from said conveyor troughs to said elevating means.

11. In a self-propelled pickup device, the improvement claimed in claim 10, in which said classifier comprises an inclined classifying screen; and means operable to direct water under pressure to the upper side of said classifying screen.

12. In a self-propelled pickup device, the improvement claimed in claim 9, in which said elevating means comprises at least one upwardly and rearwardly inclined endless belt mounted within said undercarriage; and an endless covering belt superposed on said upwardly inclined endless belt.

13. In a self-propelled pickup device, the improvement claimed in claim 1, said mounting means including driving means constituted by plural pairs of worms rotatable about axes extending in the traveling direction; the two worms of each pair being rotated in respective opposite directions.

14. In a self-propelled pickup device, the improvement claimed in claim 13, including means mounting said worms on said undercarriage for vertical adjustment relative to said undercarriage.

15. In a self-propelled pickup device, the improvement claimed in claim 13, in which said plural pairs of worms include respective pairs of worms supporting opposite sides of said undercarriage; and respective hydraulic adjusting means mounting each of said last-named pairs of worms on said undercarriage.

16. In a self-propelled pickup device, the improvement claimed in claim 13, in which said worms are multiple worms.

17. In a self-propelled pickup device, the improvement claimed in claim 16, in which said worms are quadruple worms.

18. In a self-propelled pickup device, the improvement claimed in claim 13, in which said worms are designed as hollow bodies for lifting purposes.

19. In a self-propelled pickup device, the improvement claimed in claim 18, in which said worms are filled with pressure-absorbing lifting material.

20. In a self-propelled pickup device, the improvement claimed in claim 1, in which each conveyor trough has a perforated bottom through which undesirable sediments can pass downwardly, for separation of the undesirable sediments from the desired material.

21. In a self-propelled pickup device, the improvement claimed in claim 20, in which said perforated bottom is a screen.

22. In a self-propelled pickup device, the improvement claimed in claim 20, in which said perforated bottom is a bar grate.

* * * * *